US005167852A

United States Patent [19]

Emery et al.

[11] Patent Number: 5,167,852

[45] Date of Patent: Dec. 1, 1992

[54] PROCESS FOR PREPARING PARTICULATE DETERGENT ADDITIVE BODIES AND USE THEREOF IN DETERGENT COMPOSITIONS

[75] Inventors: William D. Emery, Bromborough; William J. Iley, Poulton; Peter C. Knight, Neston, all of Great Britain

[73] Assignee: Lever Brothers Company, Division of Conopco Inc., New York, N.Y.

[21] Appl. No.: 604,030

[22] Filed: Oct. 24, 1990

[30] Foreign Application Priority Data

Nov. 13, 1989 [GB] United Kingdom ..... 8925621

[51] Int. Cl.[5] ..... C11D 3/10; C11D 3/37; C11D 3/395; C11D 11/00

[52] U.S. Cl. ..... 252/95; 252/102; 252/174.13; 252/174.23; 252/174.24; 252/186.25; 252/186.26; 252/186.42; 252/DIG. 2

[58] Field of Search ..... 252/102, 174.13, 140, 252/95, 186.2, 186.25, 186.26, 174.23, 174.24, DIG. 2; 134/26

[56] References Cited

U.S. PATENT DOCUMENTS

| | | | |
|---|---|---|---|
| 4,009,113 | 2/1977 | Green et al. . | |
| 4,087,369 | 5/1978 | Wevers | 252/102 |
| 4,120,812 | 10/1978 | Lutz | 252/186 |
| 4,265,790 | 5/1981 | Winston et al. | 252/135 |
| 4,321,157 | 3/1982 | Harris et al. | 252/174.25 |
| 4,399,049 | 8/1983 | Gray et al. . | |
| 4,497,757 | 2/1985 | Beimesch et al. | 264/13 |
| 4,681,695 | 7/1987 | Divo | 252/99 |
| 4,759,956 | 7/1988 | Amer et al. | 427/213 |
| 4,767,557 | 8/1988 | Herdeman | 252/174.13 |
| 4,828,721 | 5/1989 | Bollier | 252/140 |
| 4,917,811 | 4/1990 | Foster et al. | 252/99 |
| 4,997,590 | 3/1991 | Bowling | 252/186.31 |

FOREIGN PATENT DOCUMENTS

| | | |
|---|---|---|
| 0106634 | 6/1986 | European Pat. Off. . |
| 0340847 | 11/1989 | European Pat. Off. . |
| 0390287 | 10/1990 | European Pat. Off. . |
| 1204123 | 9/1970 | United Kingdom . |
| 1398785 | 6/1975 | United Kingdom . |
| 1441416 | 6/1976 | United Kingdom . |

OTHER PUBLICATIONS

European Search Report and Annex Jul. 30, 1991.

*Primary Examiner*—Paul Lieberman
*Assistant Examiner*—Erin M. Higgins
*Attorney, Agent, or Firm*—Milton L. Honig

[57] ABSTRACT

Sensitive and/or chemically reactive detergent additives can be shaped in the form of spherical particles having the desirable properties of being non-friable, non-dusty and at the same time fast-dissolving. The process comprises the steps of treating a mixture comprising said detergent additive and a hydratable material with a polymeric material of high Tg in a high-speed mixer/granulator. A preferred detergent additive is a peroxyacid bleach precursor.

11 Claims, No Drawings

PROCESS FOR PREPARING PARTICULATE DETERGENT ADDITIVE BODIES AND USE THEREOF IN DETERGENT COMPOSITIONS

TECHNICAL FIELD

This invention relates to detergent additive bodies in the form of particles or granules, methods of making such bodies, and use thereof in detergent compositions. In particular, it relates to a process for preparing particulate detergent additive containing bodies having improved stability, mechanical strength and attrition resistance together with excellent dispersibility and dissolution characteristics.

BACKGROUND AND PRIOR ART

It is widely recognized that the function of a number of detergent additive materials can be significantly impaired in detergent compositions by interaction between the additive material and other components of the composition. For example, enzyme, perfumes, fluorescers and bleach activators can deleteriously interact with peroxy bleaches; since organic bleach activators are generally hydrolysable compounds, they tend to hydrolyse or perhydrolyse owing to the action of moisture, alkaline substances and the percompound present in the detergent composition. Also organic peroxyacid bleach compounds and chlorine bleach compounds, such as diperoxydodecanedioic acid and the chloroisocyanurates, when incorporated in detergent compositions tend to attack oxidation-sensitive ingredients such as perfumes, fluorescers and dyes. Cationic compounds can be deleteriously affected by interaction with anionic ingredients, e.g. anionic surfactants. Numerous attempts have been made to improve the storage-stability characteristics of detergent additive materials, such as bleach activators and the like, but such attempts have in general encountered only limited success. The most common way of approaching the problem has been to protect the additive material from its hostile environment by agglomerating, coating or encapsulating the material with a non-hygroscopic, preferably hydrophobic material. Conventionally, organic materials have found the greatest favour as coating/agglomerating agents because such materials readily form a substantially cohesive and continuous plastic matrix in which the additive material can be embedded. GB-A-1 204 123, GB-A-1,441,416 and GB-A-1,398,785 are representative of this general approach.

In general, these disclosures teach the incorporation of a fine particulate bleach activator (hereinafter also referred to as peroxyacid bleach precursor), optionally with additional stabilising compounds, into larger agglomerates, using organic solids having melting points in the range of 30-°60° C. as the agglomerating agents.

Unfortunately, however, protection of sensitive ingredients within an organic plastic matrix as practised in the art can have detrimental effect on the dispersibility or dissolution characteristics of the ingredient in water, particularly at low temperatures.

U.S. Pat. No. 4,009,113 discloses granular compositions comprising from about 40% to 80% of a bleach activator and a non-hygroscopic carrier material such as paraffins and certain long-chain fatty acid or ester wherein said precursor is substantially evenly distributed in the bulk forming a composite particle. The particle has an outer protective layer which can consist of, for example, polyvinyl alcohol. The particles according to this patent can be made in a one-step process using a machine termed a "Marumeriser"® by Fuji Paudal KK, or in a two-step process wherein the precursor/carrier mixture is processed by extrusion to form extrudates, which are then broken down in a "Marumeriser" and formed into spheres and coating the spherical particles. It is stated that such compositions have both good storage stability and dispersibility in the wash water.

U.S. Pat. No. 4,399,049 (=EP-A-0062523) discloses a detergent additive composition comprising from 75% to 95% (84–90%) of a particulate solid (e.g. bleach activator) having a particle size distribution such that at least about 50% thereof passes a 250 micrometer screen, and from 5% to 25% (10–16%) of ethoxylated nonionic surfactant melting in the range of from 20° C. to 60° C., wherein said composition is prepared via a radial extrusion process. It is stated that such compositions have improved storage stability together with excellent release and dispersibility characteristics in wash water.

EP-A-0106634 discloses activator-containing bodies comprising a bleach activator and an organic binder material having a melting point not below 40° C., wherein the bleach activator and binder material are evenly distributed throughout the body such that the body has the proper density, prepared via compaction pressing or a radial extrusion process. It is stated that such bodies have both superior storage stability and dispersibility in the wash water.

Still, in all of these prior art disclosures the primary objective has been the formation of a bleach additive granule containing a peroxy bleach activator whose chemical stability could be maintained in a hostile environment, e.g. during storage under conditions of elevated temperature and humidity in intimate contact with an alkaline peroxy bleach-containing detergent. Indeed, since bleach activators, i.e. peroxyacid bleach precursors, are reactive compounds which function by the generation of peroxyacids in alkaline solutions containing a source of hydrogen peroxide, such as sodium perborate, a reaction which is often referred to as perhydrolysis, it is essential that detergent additive particles comprising a bleach activator should disperse well and dissolve rapidly into the wash liquor to obtain maximum benefit from their use. Other detergent additive materials will also benefit from these properties.

However, it is also very desirable that the detergent additive material, particularly the highly reactive peroxyacid bleach precursors and chlorinated or peroxyacid bleach compounds, be formed into granulated particles or granules, which have sufficient mechanical strength and attrition resistance to allow them to be stored and conveyed safely by bulk handling methods. The more aggressive the detergent additive material, the more important this criterion will be.

In the case of peroxyacid bleach and/or its precursors it was known how to meet the first criterion. It may also be known how to meet the second criterion, but this has hitherto been at the expense of the requirements set out for really good dispersibility and rapid dissolution of the particles.

DESCRIPTION OF THE INVENTION

The present invention seeks, as one of its objectives, to resolve these conflicting requirements by providing a process for preparing storage-stable detergent additive particles, which will have the desirable properties of being non-friable, non-dusty and at the same time fast-dissolving.

Though the invention is primarily designed and described for safe handling of particulate bodies containing highly reactive peroxyacid bleach precursors, such as the acyloxy benzene sulphonates, described in GB Patents 836,988; 839,715 and 963,135, it is also of importance for and applicable to other hazardous and aggressive detergent additive particles of which high attrition resistance upon handling is an essential requirement. For the safe handling of such reactive adjuncts, the requirements for the handling properties, particularly with respect to dustiness, should desirably be comparable to those of enzyme granules.

Needless to say that, as desired, the process of the invention can also be applied to any other sensitive detergent additives outside the above category.

Granulated particles, granules or particulate bodies in general, for being classified as non-friable, non-dusty and at the same time fast-dissolving, should desirably show an attrition value of less than 2%, preferably less than 1%; a dust yield of less than 2 mg/g, preferably less than 1 mg/g and particularly less than 0.5 mg/g; and a dissolution rate of less than 150 seconds, preferably less than 100 seconds.

It has now been found that sensitive and/or chemically reactive detergent additives can be shaped in the form of spherical particles having the above desirable properties by a high shear energy mixing process in a high-speed mixer/granulator having both a stirring action and a cutting action in the presence of a high-melting polymeric material and a hydratable material. The polymeric material used herein may be any of the homo- or copolymeric compounds known in the art, such as the homo- or copolymeric polycarboxylic acids or salts or anhydrides thereof, e.g. polyacrylic acid and copolymers of maleic acid or maleic anhydride with acrylic acid; polyvinyl pyrrolidone, which polymers should have a melting point above 80° C., preferably above 100° C. Since polymers do not normally have a true melting point, a convenient way of defining this property is by measuring the Glass Transition Temperature (see Polymer Handbook, 2nd Ed, John Wiley & Sons Inc., 1975). Preferred polymeric materials will have a Glass Transition Temperature (Tg) of from about 90° C. to about 150° C.

Preferred polymeric polycarboxylic acids for use herein are copolymers comprising:

(a) polycarboxylic acid units having the general formula I:

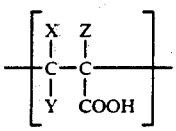

(I)

wherein X, Y and Z are each selected from hydrogen, methyl, aryl, alkaryl, carboxyl, hydroxy and carboxymethyl; at least one of X, Y and Z being selected from carboxy and carboxymethyl, provided that X and Y can be carboxymethyl only when Z is selected from carboxyl and carboxymethyl and wherein only one of X, Y and Z can be methyl, aryl, hydroxyl and alkaryl, and (b) monomer units selected from:

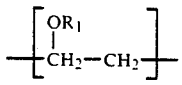

(II)

wherein $R^1$ is a $C_1$ to $C_{12}$ alkyl group or a $C_1$ to $C_{12}$ acyl group, optionally being hydroxy substituted,

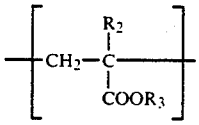

(III)

wherein $R_2$ is H or $CH_3$ and $R_3$ is H or a $C_1$ to $C_{10}$ alkyl group, $R_2$ and $R_3$ being hydroxy substituted,

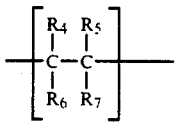

(IV)

wherein each of $R_4$ to $R_7$ is H or an alkyl group such that $R_4$ to $R_7$ together have from 1 to 20 carbon atoms, $R_4$ to $R_7$ each optionally being hydroxy substituted, and

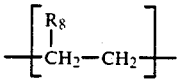

(V)

in which $R_8$ is benzyl or pyrrolidone.

Highly preferred polymeric polycarboxylic acids are copolymers of maleic acid or maleic anhydride with methyl vinyl ether, ethyl vinyl ether, or acrylic acid having Tg of about 120° C.

The hydratable material can be organic or inorganic in nature, preferably inorganic, and will preferably have a temperature of hydration of below 40° C. A suitable example of hydratable material is sodium sulphate, which will hydrate at temperatures of <32.4° C. for 10 $H_2O$ and <24.4° C. for 7 $H_2O$.

Accordingly, in one aspect the present invention provides a process for the preparation of storage-stable, non-friable, non-dusty and fast-dissolving detergent additive particles containing from about 10% to 90% by weight of active material, which process comprises the steps of treating a mixture comprising:

(a) from 10–90% by weight of a detergent additive, selected from the group consisting of peroxyacid bleach precursors, peroxyacid bleach compounds, chlorine bleach compounds and enzymes; and (b) from 5–55% by weight of a hydratable material having a temperature of hydration of below 40° C.; with (c) from 5–35% by weight of a polymeric material having a Glass Transition Temperature (Tg) of from about 90° C. to about 150° C., in a high-speed mixer/granulator, whereby granulation is effected, forming smooth spherical bodies of low porosity and of a size within the range of from 200 to 2000 μm.

Normally, the process is carried out under ambient temperature conditions without heating, and in any case at a temperature not above the hydration temperature of the hydratable material.

Since the polymeric material used is normally presented in the form of an aqueous solution, the granules obtained (discharged) from the high-speed mixer/-granulator may or may not need some drying. If drying is applied, this is preferably carried out under vacuum or in a fluid bed drier.

Normally, granules of the correct size range can be obtained directly by proper adjustment of operating conditions, though it may be necessary to apply some sieving for discarding the oversize and undersize parts of the material. Stable, non-friable, non-dusty and fast-dissolving detergent additive containing bodies manufactured according to a process using a high-speed mixer/granulator are described in our co-pending application N® 8907100.5. The process as described therein, however, uses an organic binder material having a melting point of from 25° C. to 80° C. and the particles require an outer coating to achieve the desired properties.

The present invention is distinct therefrom in that it uses a "higher melting" polymeric material of high Tg in combination with a hydratable material as the essential binder system whereby the mechanical strength and attrition resistance of the particles can be improved. Use of a polymeric material alone does not produce satisfactory results, the granules upon drying showing evidence of excessive breakdown.

Additional use of a hydratable material is thus essential and the invention thus lies in the discovery of this typical binder combination.

Without wishing to be bound to any theory, it is believed that hydrate formation occurs during the mixing/ granulation process, which will strengthen the wet granules obtained therefrom as a result of salt hydrate bridge formation, which remains during the drying step.

According to the process of the invention, detergent additive particles can be obtained having a bulk density of above 650 kg/l a shape of average sphericity greater than 0.84, a pore volume of not more than 0.4 $cm^3$/gram, a compression strength expressed in terms of compression modulus of greater than $0.5\times10^6$ $N/m^2$ and a DFR>100 ml/sec, and which are furthermore characterised by a combination of excellent storage stability, mechanical strength, attrition resistance and dissolution properties.

The peroxyacid bleach precursor.—It will be appreciated that the invention is not limited to a particular class or type of bleach activators. Any peroxyacid bleach precursor or bleach activator compound, which functions by the generation of an organic peroxyacid in alkaline solution containing a source of hydrogen peroxide, can be used in the process of the invention. These include the various peroxyacid bleach precursor compounds having a variety of structural formulae which are amply described in the patent and non-patent literature, such as in GB-Patents 836,988; 864,798; 1,003,310 and 1,529,351; German Patent 3,337,921; U.S. Pat. Nos. 1,246,339; 3,332,882; 4,128,494; 4,412,934 and 4,675,393; and EP-A-0,185,522; EP-A-0,174,132; EP-A-0,120,591; and EP-A-0,332,294, which are cited herein as non-limiting references.

A preferred class of highly reactive peroxyacid bleach precursors usable in the present invention is that of the substituted or non-substituted peroxy benzoic acid precursors of the general formula:

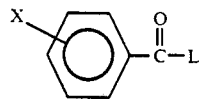

wherein X is H, a halogen (Cl, Br or F) or a straight or branched chain alkyl group containing 1–4 carbon atoms; and L is a leaving group wherein the conjugate acid of the anion formed on L has a $pK_a$ in the range of from 4-13.

Various suitable leaving groups are known in the art and any one of these leaving groups can be used provided their conjugate acid has a $pK_a$ of from 4–13. U.S. Pat. Nos. 4,412,934 and 4,483,778; EP-A-0 170 386 and EP-A-0 166 571 provide examples of desirable leaving groups, and are incorporated herein by reference.

The most preferred peroxy benzoic acid precursors have the formula:

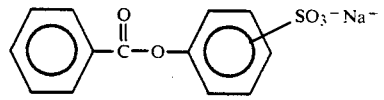

with particular preference for that in which the sulphonate group is in para-position to the acyloxy group, i.e. sodium-p-benzoyloxy benzene sulphonate.

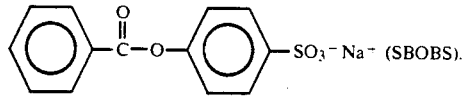

Another preferred class of reactive peroxyacid bleach precursors is that of formula:

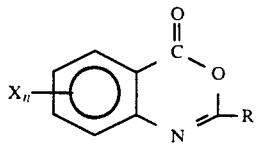

wherein R is an alkyl group having 1–9 carbon atoms, preferably 1–4 carbon atoms, particularly methyl; X is H or a suitable nuclear substituent, and n=1–4, as described in EP-A-0 332 294.

Still another preferred class of highly reactive peroxyacid bleach precursors are the quaternary ammonium compounds as described in GB Patent 1,382,594; U.S. Pat. No. 4,751,015; EP-A-0284292; EP-A-0303520 and EP-A-0331229.

The Peroxyacid Bleach Compounds

These include the organic peroxyacids and their salts and the inorganic peroxyacid salts, which are solid at room temperature and preferably have a melting point above 50° C.

Broadly organic peroxyacids can be represented by the formulae: $X\text{-}CO_3H$, wherein X is any substituent that is compatible with the peroxyacid functionality.

For example, a suitable class of organic peroxyacids is that which can be represented by general formula:

$$HO-O-\overset{O}{\overset{\|}{C}}-(O)_n-R-Y,$$

wherein R is an alkylene or substituted alkylene group containing 1 to 20 carbon atoms or an arylene group containing from 6 to 8 carbon atoms, n is 0 or 1, and Y is hydrogen, halogen, alkyl, aryl or any group which provides an anionic or cationic moiety in aqueous solution. Such groups can include, for example:

$$-\overset{O}{\overset{\|}{C}}-OM;\ -\overset{O}{\overset{\|}{C}}-O-OM;\ -\overset{O}{\overset{\|}{\underset{\underset{O}{\|}}{S}}}-OM \text{ and } -N^+R_3$$

wherein M is H or a water-soluble, salt-forming cation.

The organic peroxyacids and salts thereof can contain either one, two or more peroxy groups and can be either aliphatic or aromatic. When the organic peroxyacid is aliphatic, the unsubstituted acid may have the general formula:

$$HO-O-\overset{O}{\overset{\|}{C}}-(O)_n-(CH_2)_m-Y$$

wherein Y can be H, $-CH_3$, $-CH_2Cl$, —C—O—M, —C—O—OM, $$-\overset{O}{\overset{\|}{C}}-O-M,\ -\overset{O}{\overset{\|}{C}}-O-OM,\ -\overset{O}{\overset{\|}{\underset{\underset{O}{\|}}{S}}}-OM$$

or $-N+R_3$ and m can be an integer from 1 to 20.

Specific examples of compounds of this type are diperoxyazelaic acid, peroxylauric acid and 1,1,2-diperoxydodecanedioic acid (DPDA), and the magnesium salts thereof.

When the organic peroxyacid is aromatic, the unsubstituted acid may have the general formula:

$$HO-O-\overset{O}{\overset{\|}{C}}-(O)_n-C_6H_4-Y$$

wherein Y is, for example, hydrogen, halogen, alkyl, $$-\overset{O}{\overset{\|}{C}}-OM,\ -\overset{O}{\overset{\|}{C}}-O-OM,\ -\overset{O}{\overset{\|}{\underset{\underset{O}{\|}}{S}}}-OM,$$

$$-(CH_2)_nN^+R_3 \text{ or } -\overset{O}{\overset{\|}{\underset{\underset{O}{\|}}{S}}}-C_6H_4-CO_3M.$$

The percarboxy or percarbonic and Y groupings can be in any relative position around the aromatic ring. The ring and/or Y group (if alkyl) can contain any non-interfering substituents, such as halogen or sulphonate groups.

Specific examples of such aromatic peroxyacids and salts thereof include peroxybenzoic acid, m-chloroperoxybenzoic acid, p-nitro-peroxybenzoic acid, p-sulphonato-peroxybenzoic acid, diperoxyisophthalic acid, peroxy-alpha-naphthoic acid, and 4,4'-sulphonyldiperoxybenzoic acid and magnesium salts thereof.

Other peroxyacids of particular interest usable in this invention have the general formula:

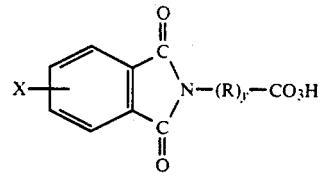

wherein X is H, alkyl chain, a halogen, a carboxyl group in any position in the aromatic ring, or the same peroxyacid group:

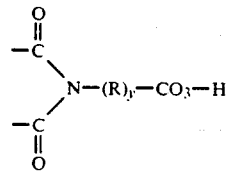

in symmetrical position to the first peroxyacid group in the aromatic ring;

R is a straight or branched chain lower alkylene, preferably $-CH_2-$; and

Y is between 1 and 12, preferably 3–8.

A preferred compound of this group is a peroxyacid having the formula:

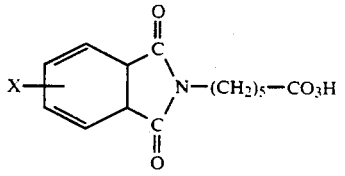

A specific example of inorganic peroxyacid salts is potassium monopersulphate. A product comprising this compound is the triple salt, $K_2SO_4.KHSO_4.2KHSO_5$, available commercially under the trade-name Oxone ® from E.I. Dupont de Nemours and Company.

The Manufacturing Process

The invention necessarily requires a high shear energy mixing process. The process uses a high-speed mixer/granulator equipment having both a stirring action of high energy and a cutting action. Equipments for high shear energy processing are known and may generally be subdivided according to whether the mixing shaft, to which are attached a mixing impeller or mixing impellers, is mounted either vertically or horizontally. When the shaft is vertical, a single mixing impeller which rotates in a horizontal plane is mounted within a close-fitting bowl-shaped vessel. The rotation of the impeller imparts a high shear energy mixing to the powder. When the shaft is horizontal, one or more mixing impeller blades which rotate in a vertical plane are mounted within a close-fitting cylindrical vessel. Rotation of the impeller blades imparts a high shear energy to the powder.

In addition, it is common practice to fit within the vessels small chopper blades which rotate at about 1000 rpm or more, and which serve to disintegrate oversize material produced during agglomeration. Both types of these high-speed mixer/granulators are commercially available and can be used to produce the detergent additive containing bodies of the invention as rounded, mechanically strong particles.

The Fukae (Trade Mark) FS-G mixer manufactured by Fukae Powtech Kogyo Co., Japan, has been found to give excellent results in batchwise operation. This apparatus is essentially in the form of a vessel accessible via a top port, provided near its base with a stirrer having a substantially vertical axis, and a cutter positioned on a side wall. Preferably, the stirrer and cutter may be operated independently of one another, and at separately variable speeds.

Other mixers suitable for use in the process of the invention include the Diosna (Trade Mark) V series ex Dierks & Söhne, Germany; the Lödige (Trade Mark) FM series ("ploughshare" mixer) ex Morton Machine Co. Ltd, Scotland; and the Pharma Matrix (Trade Mark) ex T.K. Fielder Ltd, England. Other mixers believed to be suitable for use in the process of the invention are the Fuji (Trade Mark) VG-C series ex Fuji Sangyo Co., Japan; the Lödige MTG ex Morton Machine Co. Ltd, Scotland; and the Roto (Trade Mark) ex Zanchetta & Co. S.r.l., Italy.

The Lödige FM mixer differs from the Fukae mixer mentioned above in that its stirrer has a horizontal axis; this configuration is suitable for continuous operation.

Definitions

Sphericity is the ratio of the surface area of a sphere with the same volume as the particle to its actual surface area, and can be estimated by microscopy according to a method described by G. Herdan in "Small Particle Statistics", Butterworths, London, 2nd Edition, 1960.

Pore volume is measured by mercury porosimetry as described by T. Allen in "Particle Size Measurement", Chapman and Hall, London, 3rd Edition, 1980.

The compression modulus of the particles was measured as follows:

A granule sample was placed in a cylindrical die of 16 mm diameter and 6 mm deep. The granules were compressed by lowering a piston into the die and simultaneously measuring the force. The force required to produce a strain of 30% (1.8 mm compression) was measured. This was then expressed as a stress and converted to a modulus by dividing by the strain (0.3).

Attrition value is measured using a spouted bed test, described in ISO/TC 47/WG 11, 1972, "Sodium perborate for industrial use, determination of rate of attrition".

Dust yield is measured using a fluid bed dust elutriation test. The fluid bed used had an internal diameter of 34.5 mm and was 2000 mm tall. Air was supplied to the bed at superficial gas velocity of 0.8 m/sec. through a sintered glass distributor. The bed was filled with 60 grams of granules. Elutriation was carried out for 40 minutes. Elutriated dust. was collected and weighed.

Dissolution rate is the time taken for 90% of the detergent additive material to have dissolved in water of 23° C., buffered at pH 10, in a standard test wherein a weight of 250 mg granules was added to 500 ml of water in an agitated vessel.

Dynamic Flow Rate (DFR) in ml/sec. is measured using a cylindrical glass tube having an internal diameter of 35 mm and a length of 600 mm. The tube was securely clamped with its longitudinal axis vertical. Its lower end was terminated by means of a smooth cone of polyvinyl chloride having an internal angle of 15° and a lower outlet orifice of diameter 22.5 mm. A beam sensor was positioned 150 mm above the outlet, and a second beam sensor was positioned 250 mm above the first sensor.

To determine the dynamic flow rate of a powder sample, the outlet orifice was temporarily closed, for example, by covering with a piece of card, and powder was poured into the top of the cylinder until the powder level was about 100 mm above the upper sensor. The outlet was then opened and the time t (seconds) taken for the powder level to fall from the upper sensor to the lower sensor was measured electronically. The result is the tube volume between the sensors, divided by the time measured.

As further improvement of the attrition resistance properties and further reduction of the dust yield to the lowest possible value, the particles obtained from the high-speed mixer/granulator may optionally be provided with up to about 20% by weight of an outer coating so long as the coating does not affect the specified dissolution rate.

Suitable coating materials are, for example, organic materials having a melting point of less than 60° C. and a solubility in water at 40° C. greater than 20% by weight. Typical examples of such materials are nonionic surfactants, fatty acids and fatty acid soaps, polyethylene glycols, anionic surfactants and mixtures thereof, polyethylene glycols (PEG's) being especially suitable, which include both liquid and solid PEG's, e.g. liquid PEG 300 and solid PEG 1200. These are materials which are very soluble and, being of low viscosity, easy to handle.

For simplicity's sake, the invention will now be further described with particular reference to a preferred peroxyacid bleach precursor, namely sodium parabenzoyloxy benzene sulphonate (SBOBS), it being understood that this does not imply a limitation, other peroxyacid bleach precursors and detergent additives as discussed above equally being usable in the practice of this invention.

As explained hereinbefore, the mixture treated in the high-speed mixer/granulator will comprise:

(a) from 10–90% by weight of the detergent additive;
(b) from 5–55% by weight of the hydratable material; and
(c) from 5–35% by weight of the polymeric material.

These ranges apply generally to the various types of usable detergent additives. For peroxyacid bleach precursors, especially SBOBS, the preferred ranges are: 60–85% by weight of (a), 5–30% by weight of (b) and 10–20% by weight of (c), with ratios of (b) : (a) of between 1:9 and 3:7 being of clear benefit, particularly 2:8.

As indicated above, the use of a high-speed mixer/granulator and the use of a high Tg polymeric material/hydratable material combination as the binder system are essential elements in the process of the invention to effect the formation of smooth, spherically shaped strong particles of low porosity and high stability, which are safe for being handled in bulk.

Water which is usually present as the solvent medium for the polymeric material appears to have the advantageous property of acting as plasticiser for the high Tg polymer which in turn provides for the elastomechanical properties of the granules. Other plasticisers such as glycerol, sorbitol glycols of propylene glycol may also be used in addition to or in replacement of water. The contents of such plasticizers including moisture defining the elastomechanical properties of the granule may range from 2 to 15% by weight of the total granular composition.

In the operation of the process of the invention a premix of the detergent additive, e.g. SBOBS, and the hydratable material is advantageously charged into the high-speed mixer/granulator equipment and agitation is started onto which the aqueous polymeric material is added. If additional components such as clays, dispersants and water-swellable materials, and stabilisers such as the Dequest® ethylene diamine tetra(methylene phosphonic acid) and ethylene diamine tetraacetic acid (EDTA) are desirably incorporated in the granule, these will be advantageously included in the premix.

The new detergent additive containing bodies (particles or granules) of the aforementioned size obtained according to the process of the invention are extremely suitable to be safe-handled for incorporation in detergent powder compositions.

Accordingly, detergent powder compositions comprising the particulate detergent additive product as described and prepared hereinabove are within the purview of the present invention.

When the detergent additive material is a bleach activator (a peroxyacid bleach precursor), the detergent composition requires as an essential component a peroxide bleaching compound capable of yielding hydrogen peroxide in aqueous solution.

Hydrogen peroxide sources are well known in the art. They include the alkali metal peroxides, organic peroxide compounds such as urea peroxide, and the inorganic persalts, such as the alkali metal perborates, percarbonates, perphosphates and persulphates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. This rapid dissolution will further contribute to the formation of higher levels of peroxycarboxylic acid, thereby enhancing surface bleaching performance.

Typically, the molar ratio of hydrogen peroxide (or a peroxide compound generating the equivalent amount of $H_2O_2$) to precursor may range from 0.5:1 to about 20:1, preferably 1:1 to 10:1.

A detergent formulation containing the bleach activator granules of the invention will usually also contain surface-active materials, detergency builders and other known ingredients of such formulations. In such formulations the bleach activator granules may be incorporated in an amount wherein the peroxyacid bleach precursor is present at a level ranging from about 0.1% to 20% by weight, preferably from 0.5% to 10% by weight, particularly from 1% to 7.5% by weight, together with a peroxide bleaching compound, e.g. sodium perborate mono- or tetra-hydrate, the amount of which is usually within the range of from about 2% to 40%, preferably from about 4% to 30%, particularly from about 10% to 25% by weight.

The surface-active material may be naturally derived, such as soap, or a synthetic material selected from anionic, nonionic, amphoteric, zwitterionic, cationic actives and mixtures thereof. Many suitable actives are commercially available and are fully described in literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4% to 25%.

The detergent compositions of the invention will normally also contain a detergency builder. Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. Nos. 4,144,226 and 4,146,495.

Examples of precipitating builder materials include sodium orthophosphate, sodium carbonate and long-chain fatty acid soaps.

Examples of calcium ion-exchanging builder materials include the various types of water-insoluble crystalline or amorphous aluminosilicates, of which zeolites are the best known representatives.

In particular, the compositions of the invention may contain any one of the organic or inorganic builder materials, such as sodium or potassium tripolyphosphate, sodium or potassium pyrophosphate, sodium or potassium orthophosphate, sodium carbonate, the sodium salt of nitrilotriacetic acid, sodium citrate, carboxymethyl malonate, carboxymethyloxy succinate and the water-insoluble crystalline or amorphous aluminosilicate builder materials, or mixtures thereof.

These builder materials may be present at a level of, for example, from 5 to 80% by weight, preferably from 10 to 60% by weight.

Apart from the components already mentioned, the detergent compositions of the invention can contain any of the conventional additives—if not already included in the instant granules—in the amounts in which such materials are normally employed in fabric-washing detergent compositions. Examples of these additives include lather boosters, such as alkanolamides, particularly the monoethanol amides derived from palmkernel fatty acids and coconut fatty acids, lather depressants, such as alkyl phosphates and silicones, anti-redeposition agents, such as sodium carboxymethyl cellulose and alkyl or substituted alkyl cellulose ethers, peroxide stabilizers, such as ethylene diamine tetraacetic acid and preferably phosphonates, e.g. ethylene diamine tetramethylene phosphonic acid and diethylene triamine penta-methylene phosphonic acid or their salts, fabric-softening agents, inorganic salts, such as sodium sulphate, and, usually present in very small amounts, fluorescent agents, perfumes, enzymes, such as proteases, cellulases, lipases and amylases, germicides and colourants.

The following examples will more fully illustrate the embodiments of the invention. All parts, percentages and proportions referred to herein are by weight unless otherwise illustrated.

EXAMPLES I and II

SBOBS (peroxyacid bleach precursor) powder ex Monsanto was granulated with Sokalan45® (a high-melting, partly neutralised maleic anhydride/acrylic acid copolymer ex BASF) in the form of an aqueous solution with a liquid/solid ratio of 0.16, in a Fukae®

FS 30 high-speed mixer/granulator, with no added sodium sulphate (batch A).

Two other batches I and II were prepared in the same manner, wherein part of the SBOBS was replaced by sodium sulphate at levels of 10% and 20%, respectively. In all experiments, cooling water was circulated through the jacket of the agglomerator to promote hydrate formation.

| The process steps and conditions were: | Time |
|---|---|
| (1) Charge 10 kg of SBOBS or premix (SBOBS + $Na_2SO_4$) to the Fukae FS 30 mixer: | 1-2 mins |
| (2) Charge 2.67 kg of the CP 45 polymer at ambient temperature via the feed hopper with agitator at 75 rpm and chopper at 3000 rpm to disperse the polymer in the SBOBS or premix: | 6 mins |
| (3) Increase agitator speed to 100 rpm and agglomerate: | |
| for Batch A: | 10 mins |
| for Batch I and II each: | 2 mins |

After this cycle the wet granules were discharged from the mixer/granulator and were dried in an Aeromatic fluid bed drier to a moisture content of 2-3% by weight, and sieved to a size of less than 2000 μm.

The oversize particles were discarded; they can be milled and recycled to the Fukae mixer in a full-scale process.

The dry granule compositions were:

| Composition (%) | Batch A | Batch I | Batch II |
|---|---|---|---|
| SBOBS | 89.3 | 71.4 | 80.4 |
| $Na_2SO_4$ | — | 17.9 | 8.9 |
| CP 45 polymer | 10.7 | 10.7 | 10.7 |
| Yield of <2 mm particles | — | 85% | 81% |

The wet granules from Batches I and II of the invention discharged cleanly from the mixer with no fouling.

The wet granules from Batch A without sodium sulphate discharged with clear evidence of fouling.

Batches I and II of the invention gave stronger wet granules which fluid bed dried with very little breakdown, in contrast to granules from Batch A which upon fluid bed drying showed significant breakdown.

It was also noted, as shown above, that the granulation time for Batches I and II was much shorter (i.e. about 2 minutes) than for Batch A (i.e. about 10 minutes).

EXAMPLE III

The granules from Batch I after drying were split into two parts I(i) and I(ii).

I(i) was coated with 30% of liquid PEG 300 and I(ii) was coated with 12% of solid PEG 1200.

The granules showed a bulk density of 833 kg/l and a DFR value greater than 100 ml/sec.

These granules were subjected to an elutriation test normally used for dustiness testing of detergent enzyme encapsulates, with excellent results comparable to the requirement as set for safe-handling of detergent enzyme particles.

We claim:

1. A process for preparing detergent additive bodies, said bodies having a composition comprising:

(a) from 10 to 90% by weight of a peroxyacid bleach precursor;

(b) from 5 to 55% by weight of a hydratable material having a temperature of hydration below 40° C.; and (c) from 5 to 35% by weight of a polymeric material having a Glass Transition Temperature of from about 90° C. to about 150° C.;

said process comprising the steps of:

(i) introducing said precursor, hydratable material and polymer material into a mixer/granulator to thereby form a mixture;

(ii) subjecting said mixture to high-shear energy mixing and thereby granulating said mixture to form said additive bodies, said formed bodies being smooth, spherical, of low porosity and of a size within the range of from 200 to 2000 μm.

2. A process according to claim 1, wherein the process is carried out at a temperature not above the hydration temperature of the hydratable material.

3. A process according to claim 1, wherein the hydratable material is sodium sulphate.

4. A process according to claim 1, wherein the polymeric material is a homo- or copolymeric polycarboxylic acid.

5. A process according to claim 4, wherein the polymeric material is a copolymer of maleic acid or maleic anhydride with methyl vinyl ether, ethyl vinyl ether or acrylic acid having Tg of about 120° C.

6. A process according to claim 1, wherein said peroxyacid bleach precursor is sodium p-benzoyloxy benzene sulphonate.

7. A process according to claim 1, wherein the amount of component (a) is from 60-85% by weight, component (b) is from 5-30% by weight and component (c) is from 10-20% by weight, the ratio of (b) : (a) being from 1 : 9 to 3 : 7.

8. A process according to claim 1, wherein the granules obtained from the high-speed mixer/granulator are further dried to a moisture content of from 2-15% by weight of the granule composition.

9. A process according to claim 1, wherein the granules are provided with an outer coating of an organic material having a melting point of less than 60° C. and a solubility in water at 40° C. greater than 20% by weight.

10. A process according to claim 9, wherein said coating material is polyethylene glycol.

11. A process according to claim 1, wherein the process is carried out under ambient temperature conditions without heating.

* * * * *